US010119369B2

(12) United States Patent
Saurer

(10) Patent No.: US 10,119,369 B2
(45) Date of Patent: Nov. 6, 2018

(54) METHODS AND SYSTEMS FOR ORIENTING IN A WELLBORE

(71) Applicant: Halliburton Energy Services, Inc., Houston, TX (US)

(72) Inventor: Dan P. Saurer, Plano, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 251 days.

(21) Appl. No.: 14/900,717

(22) PCT Filed: Aug. 26, 2013

(86) PCT No.: PCT/US2013/056694
§ 371 (c)(1),
(2) Date: Dec. 22, 2015

(87) PCT Pub. No.: WO2015/030716
PCT Pub. Date: Mar. 5, 2015

(65) Prior Publication Data

US 2016/0265314 A1 Sep. 15, 2016

(51) Int. Cl.
*E21B 41/00* (2006.01)
*E21B 23/12* (2006.01)
(Continued)

(52) U.S. Cl.
CPC ..... *E21B 41/0035* (2013.01); *E21B 17/006* (2013.01); *E21B 23/002* (2013.01); *E21B 34/10* (2013.01); *E21B 47/09* (2013.01)

(58) Field of Classification Search
CPC .. E21B 41/0035; E21B 17/006; E21B 23/002; E21B 34/10; E21B 47/09
See application file for complete search history.

(56) References Cited

U.S. PATENT DOCUMENTS 5,579,829 A 12/1996 Comeau et al.
6,244,340 B1 6/2001 McGlothen et al.
(Continued)

FOREIGN PATENT DOCUMENTS

BY 12238 C1 8/2009
CN 193036 A 3/2007
(Continued)

OTHER PUBLICATIONS

Chinese Office Action for CN 201380078143.8, dated Apr. 28, 2017, 25 pages with translation.
(Continued)

*Primary Examiner* — Matthew R Buck
*Assistant Examiner* — Aaron L Lembo

(57) ABSTRACT

A method for orienting a tubing string in a wellbore comprises lowering a tubular string within a casing string in a wellbore, engaging the tubular aligning tool with a casing aligning tool while lowering the tubular string, rotating the tubular string in response to engaging the tubing aligning tool with the casing aligning tool, rotationally aligning the tubular string opening with a casing string opening disposed through the casing string based on the rotating, and retaining the tubular string opening in an axial aligning and a rotational aligning with the casing string opening. The tubular string comprises: a tubular string opening and a tubular string aligning tool.

22 Claims, 7 Drawing Sheets

(51) Int. Cl.

| | |
|---|---|
| ***E21B 17/00*** | (2006.01) |
| *E21B 34/10* | (2006.01) |
| *E21B 47/09* | (2012.01) |

(56) References Cited

U.S. PATENT DOCUMENTS

| | | | | |
|---|---|---|---|---|
| 6,354,375 | B1 | 3/2002 | Dewey | |
| 7,083,005 | B2 | 8/2006 | Galloway et al. | |
| 8,376,054 | B2 | 2/2013 | Lang et al. | |
| 8,453,728 | B2 | 6/2013 | Heburn | |
| 2002/0066577 | A1* | 6/2002 | Dewey | E21B 7/061 166/382 |
| 2002/0195249 | A1 | 12/2002 | Murray | |
| 2004/0011529 | A1* | 1/2004 | McGarian | E21B 41/0035 166/313 |
| 2004/0035581 | A1 | 2/2004 | Cavender | |
| 2004/0168807 | A1 | 9/2004 | McGlothen et al. | |
| 2005/0006100 | A1* | 1/2005 | Murray | E21B 41/0035 166/313 |
| 2005/0217858 | A1 | 10/2005 | Galloway et al. | |
| 2010/0170677 | A1* | 7/2010 | Ingraham | E21B 41/0035 166/313 |
| 2011/0186291 | A1 | 8/2011 | Lang et al. | |
| 2013/0192840 | A1 | 8/2013 | Wolf et al. | |
| 2013/0327572 | A1* | 12/2013 | Sponchia | E21B 41/0035 175/61 |
| 2014/0090894 | A1* | 4/2014 | Wolf | E21B 41/0042 175/61 |

FOREIGN PATENT DOCUMENTS

| | | | |
|---|---|---|---|
| CN | 102146777 | A | 8/2011 |
| CN | 103154426 | A | 6/2013 |
| RU | 2449107 | C2 | 4/2012 |

OTHER PUBLICATIONS

Intellectual Property Office of Singapore, Written Opinion, Feb. 3, 2017, 5 pages, Singapore.

The Federal Institue of Industrial Property, Office Action, daed Oct. 19, 2016, 6 pages, Russia.

The Federal Institue of Industrial Property, Office Action, English Translation, Oct. 19, 2016, 4 pages, Russia.

International Search Report and The Written Opinion of the International Searching Authority, or the Declaration, dated May 23, 2014, PCT/US2013/056694, 12 pages, ISA/KR.

European Patent Office, Application No. 13892572.2, Supplementary Partial European Search Report, dated Jul. 25, 2017, 9 pages, Europe.

* cited by examiner

METHODS AND SYSTEMS FOR ORIENTING IN A WELLBORE

The present application is a U.S. National Stage patent application of International patent application No. PCT/US2013/056694, filed on Aug. 26, 2013, the benefit of which is claimed and the disclosure of which is incorporated herein by reference in its entirety.

BACKGROUND

The present application relates to orienting a wellbore tubular within a wellbore. Wellbore tubulars can be used to extract hydrocarbons from lateral wellbores intersecting with a primary wellbore. Wellbore tubulars may comprise openings and/or windows that align with openings along the primary wellbore which lead to lateral wellbores. However, when a wellbore tubular is inserted into the wellbore the wellbore tubular may require longitudinal and/or rotational orientation so that the openings and/or windows align with openings which lead to lateral wellbores. Longitudinal and/or rotational movement of the wellbore tubular may cause stress and/or breaking of control lines.

SUMMARY

In an embodiment, a method for orienting a tubing string in a wellbore comprises lowering a tubular string within a casing string in a wellbore, engaging the tubular aligning tool with a casing aligning tool while lowering the tubular string, rotating the tubular string in response to engaging the tubing aligning tool with the casing aligning tool, rotationally aligning the tubular string opening with a casing string opening disposed through the casing string based on the rotating, and retaining the tubular string opening in an axial aligning and a rotational aligning with the casing string opening. The tubular string comprises: a tubular string opening and a tubular string aligning tool.

In an embodiment, a method for orienting a tubular string in a wellbore comprises lowering a tubular string within a casing string in a wellbore, engaging the first tubular aligning tool with a first casing aligning tool while lowering the tubular string, rotating the first tubular string portion in response to engaging the first tubular aligning tool with the first casing aligning tool, rotationally aligning the first tubular string opening with a first casing string opening based on the rotating, retaining the first tubular string portion in an axial alignment and a rotational alignment with respect to the first casing opening, lowering the second tubular string portion relative to the first tubular string portion, engaging the second tubular aligning tool with a second casing aligning tool while lowering the second tubular string portion relative to the first tubular string portion, rotating the second tubular string portion in response to engaging the second tubular aligning tool with the second casing aligning tool while the first tubular string portion is retained in position, rotationally aligning the second tubular string opening with a second casing string opening based on rotating the second tubular string portion, and retaining the second tubular string portion in an axial alignment and a rotational alignment with respect to the second casing string opening. The tubular string comprises: a first tubular string portion and a second tubular string portion. The first tubular string portion comprises a first tubular string opening and a first tubular aligning tool, and the second tubular string portion comprises a second tubular string opening and a second tubular aligning tool. The first tubular string portion is disposed below the second tubular string portion.

In an embodiment, a system for orienting a tubular string with a wellbore comprises a casing string disposed in the wellbore and a first tubular string portion coupled to a second tubular string portion. The casing string comprises: a casing string bore defined by the casing string, a first casing string opening and a second casing string opening, and a first casing aligning tool and a second casing aligning tool coupled to the casing string. The first casing string opening is further away from a wellbore surface than the second casing string opening, and the first tubular string portion and the second tubular string portion are configured to be displaced into the casing string bore. The first tubing string portion comprises: a first tubular string opening configured to radially align with the first casing string opening, a first tubular aligning tool configured to engage with the first casing aligning tool upon being lowered into the wellbore and rotate the first tubular string portion to at least partially align the first tubular string opening with the first casing string opening, and a first holding device configured to prevent axial displacement of the first tubing string portion when the first tubing string opening is at least partially aligned with the first casing string opening.

These and other features will be more clearly understood from the following detailed description taken in conjunction with the accompanying drawings and claims.

BRIEF DESCRIPTION OF THE DRAWINGS

For a more complete understanding of the present disclosure and the advantages thereof, reference is now made to the following brief description, taken in connection with the accompanying drawings and detailed description.

DETAILED DESCRIPTION OF THE EMBODIMENTS

Figure 1:
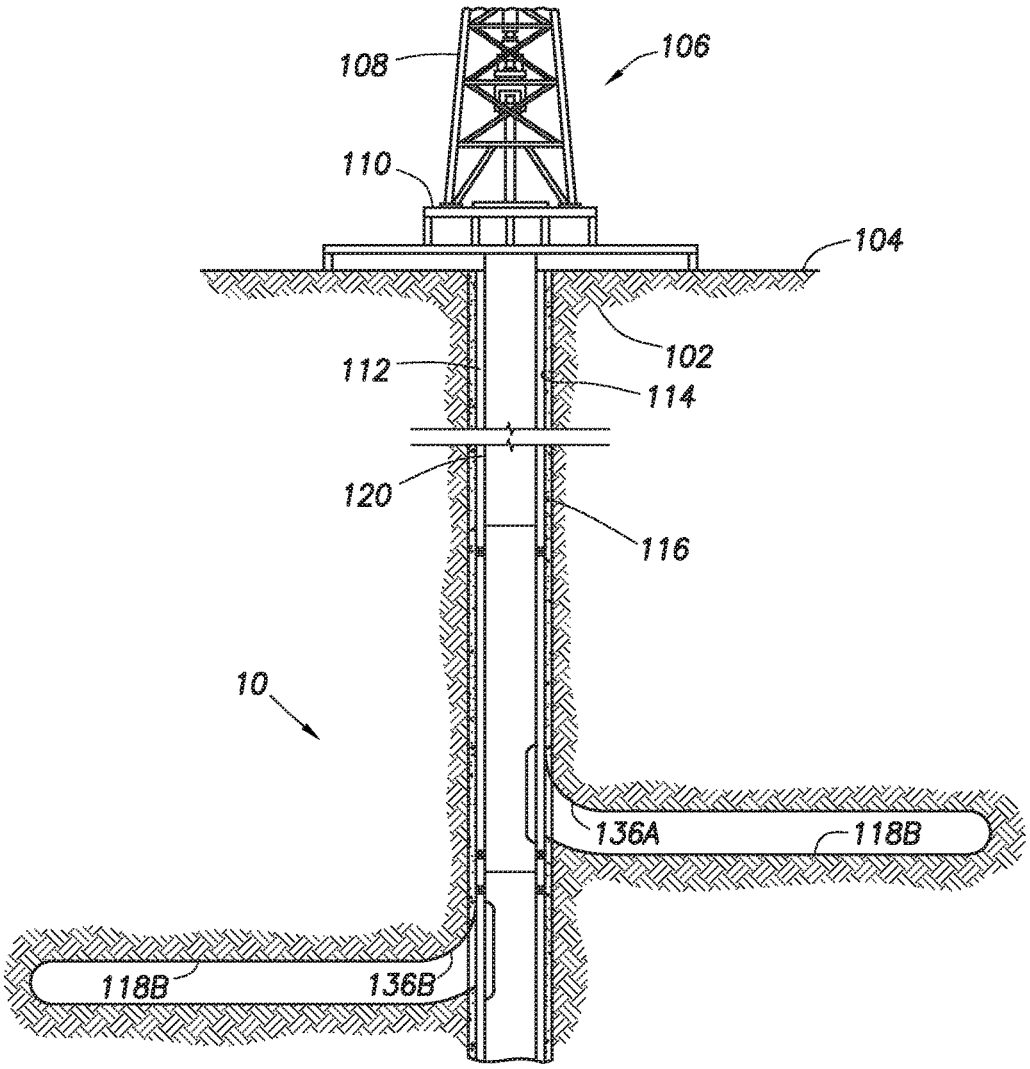
FIG. 1 is a schematic view of an embodiment of a wellbore servicing system according to an embodiment.

In the drawings and description that follow, like parts are typically marked throughout the specification and drawings with the same reference numerals, respectively. The drawing figures are not necessarily to scale. Certain features of the invention may be shown exaggerated in scale or in somewhat schematic form and some details of conventional elements may not be shown in the interest of clarity and conciseness.

Unless otherwise specified, any use of any form of the terms "connect," "engage," "couple," "attach," or any other term describing an interaction between elements is not meant to limit the interaction to direct interaction between the elements and may also include indirect interaction between the elements described. In the following discussion and in the claims, the terms "including" and "comprising" are used in an open-ended fashion, and thus should be interpreted to mean "including, but not limited to . . . ".

Reference to up or down will be made for purposes of description with "up," "upper," "upward," or "upstream" meaning toward the surface of the wellbore and with "down," "lower," "downward," or "downstream" meaning toward the terminal end of the well, regardless of the wellbore orientation. Reference to in or out will be made for purposes of description with "in," "inner," or "inward" meaning toward the center or central axis of the wellbore, and with "out," "outer," or "outward" meaning toward the wellbore tubular and/or wall of the wellbore. Reference to "longitudinal," "longitudinally," or "axially" means a direction substantially aligned with the main axis of the wellbore and/or wellbore tubular. Reference to "radial" or "radially" means a direction substantially aligned with a line between the main axis of the wellbore and/or wellbore tubular and the wellbore wall that is substantially normal to the main axis of the wellbore and/or wellbore tubular, though the radial direction does not have to pass through the central axis of the wellbore and/or wellbore tubular. The various characteristics mentioned above, as well as other features and characteristics described in more detail below, will be readily apparent to those skilled in the art with the aid of this disclosure upon reading the following detailed description of the embodiments, and by referring to the accompanying drawings.

Lateral wellbores can be drilled from a main wellbore, creating a branch at the intersection of the two wellbores. A window is generally created in the main wellbore that leads to the lateral wellbore and serves as the opening or entrance to the lateral wellbore. In order to pass tools to the appropriate wellbore, an alignment mechanism can be used to properly align an opening in a wellbore tubular in the main wellbore with the window leading to the lateral wellbore. The alignment can involve rotational alignment as well as axial alignment. Some wellbores have a plurality of lateral wellbores that may be drilled with various orientations relative to the main wellbore. A plurality of alignment mechanisms may then be used to properly align a corresponding plurality of openings in a wellbore tubular located in the main wellbore with each of the windows to the lateral wellbores.

As described herein, an alignment mechanism for use with one or more lateral wellbores may provide a mechanism to both rotationally and axially align an opening in the wellbore tubular located in the main wellbore with a window to a lateral wellbore. When multiple lateral wellbores are present, the alignment mechanisms can allow for independent rotational and axial alignment of the openings in the wellbore tubular with the windows to the lateral wellbores. For example, the wellbore tubular may be aligned while being lowered into the wellbore. In this procedure, the wellbore tubular may be inserted into the wellbore and the lowest opening in the wellbore tubular may be first aligned with the lowest lateral wellbore using downward movement in the wellbore. The engagement of the lower portion with a casing alignment tool may provide a rotational lock to prevent rotation of the lower portion once the lower portion is properly positioned. The ability to rotationally lock the lower portion may aid in maintaining the proper alignment even if a portion of the wellbore tubular above the lower portion rotates, for example during a subsequent alignment with a window to a lateral wellbore. The wellbore tubular may then be telescoped to shorten the tubular string. The lowest portion of the wellbore tubular may then remain locked in position while an opening in an upper portion is rotationally and axially aligned with a window above the lowest window. This process may be repeated a suitable number of times to align each wellbore tubular portion with a corresponding window to a lateral wellbore. In some embodiments, control lines may be disposed along the wellbore tubular and used to actuate various devices in the wellbore. The alignment mechanisms and wellbore tubular may be configured to properly align openings in the wellbore tubular with the windows to the lateral wellbores without over-rotating or damaging the control lines. For example, the direction of rotation of each opening in the wellbore tubular can be controlled to prevent continuous rotation in a single direction during the alignment process.

Referring to FIG. 1, an example of a wellbore operating environment is shown. As depicted, the operating environment comprises a drilling rig 106 that is positioned on the earth's surface 104 and extends over and around a wellbore 114 that penetrates a subterranean formation 102 for the purpose of recovering hydrocarbons. The wellbore 114 may be drilled into the subterranean formation 102 using any suitable drilling technique. The wellbore 114 extends substantially vertically away from the earth's surface 104 over a vertical wellbore portion 116, deviates from vertical relative to the earth's surface 104 over deviated wellbore portions 136A and 136B, and transitions to horizontal wellbore portions 118A and 118B. In alternative operating environments, all or portions of a wellbore may be vertical, deviated at any suitable angle, horizontal, and/or curved. The wellbore may be a new wellbore, an existing wellbore, a straight wellbore, an extended reach wellbore, a sidetracked wellbore, a multi-lateral wellbore, and other types of wellbores for drilling and completing one or more production zones. Further the wellbore may be used for both producing wells and injection wells. In an embodiment, the wellbore may be used for purposes other than or in addition to hydrocarbon production, such as uses related to geothermal energy.

A wellbore tubular string 120 comprising a wellbore tubular orientation system 10 may be lowered into the subterranean formation 102 for a variety of workover or treatment procedures throughout the life of the wellbore. The embodiment shown in FIG. 1 illustrates the wellbore tubular 120 in the form of a tubular string being lowered into the subterranean formation 102. It should be understood that the wellbore tubular 120 comprising wellbore tubular orientation system 10 is equally applicable to any type of wellbore tubular string being inserted into a wellbore, including as non-limiting examples drill pipe, production tubing, rod strings, coiled tubing, and/or casing. The wellbore tubular orientation system 10 may be used to align windows and/or openings on the wellbore tubular string 120 with openings which lead to lateral wellbores. Lateral wellbores may comprise wellbores which branch off of a primary wellbore extending into the subterranean from the surface. In the embodiment shown in FIG. 1, the wellbore tubular 120 comprising the wellbore tubular orientation system 10 is conveyed into the subterranean formation 102 in a conventional manner and may pass through a casing that can be secured within the wellbore 114 by filling an annulus 112 between the casing and the wellbore 114 with cement.

The drilling rig 106 comprises a derrick 108 with a rig floor 110 through which the wellbore tubular 120 extends downward from the drilling rig 106 into the wellbore 114. The drilling rig 106 comprises a motor driven winch and other associated equipment for extending the wellbore tubular 120 into the wellbore 114 to position the wellbore tubular 120 at a selected depth. While the operating environment depicted in FIG. 1 refers to a stationary drilling rig 106 for lowering and setting the wellbore tubular 120 comprising the wellbore tubular orientation system 10 within a landbased wellbore 114, in alternative embodiments, mobile workover rigs, wellbore servicing units (such as coiled tubing units), and the like may be used to lower the wellbore tubular 120 comprising the wellbore tubular orientation system 10 into a wellbore. It should be understood that a wellbore tubular 120 comprising the wellbore tubular orientation system 10 may alternatively be used in other operational environments, such as within an offshore wellbore operational environment.

In alternative operating environments, a vertical, deviated, or horizontal wellbore portion may be cased and cemented and/or portions of the wellbore may be uncased. In an embodiment, a wellbore tubular orientation system 10 may be used on production tubing in a cased wellbore.

Figure 2:
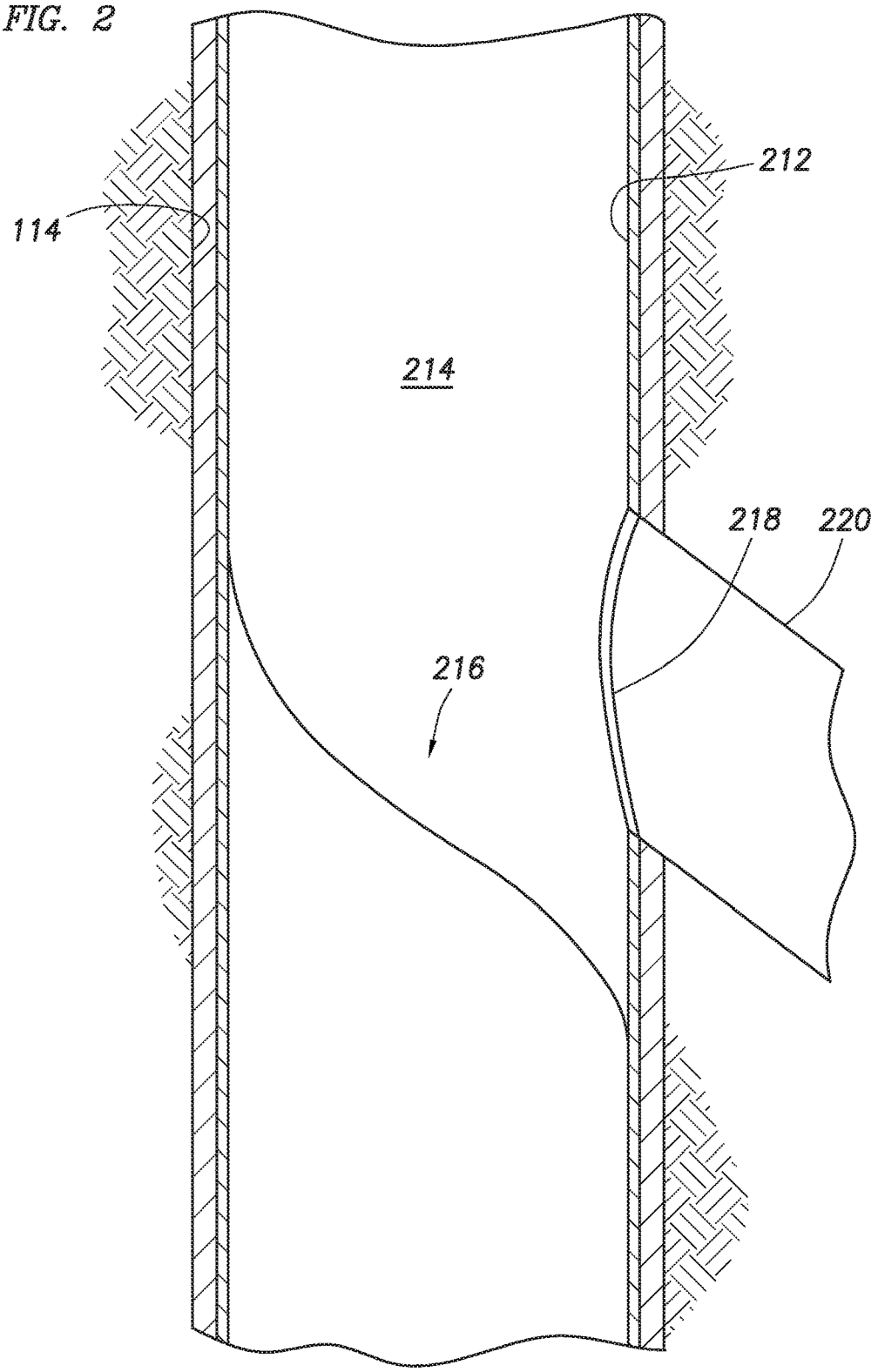
FIG. 2 is a cross-sectional view of an embodiment of a wellbore servicing system according to an embodiment.

FIG. 2 depicts a wellbore 214 with a tubular string, such as casing string 212, comprising one or more aligning tools 216 associated with one or more openings 218 and coupled with the wall of the wellbore or the interior wall of a tubular string. For example, a casing string 212 disposed in the wellbore 214 and secured to the wall of the wellbore 214, may define a casing string bore 222 capable of communicating fluid, such as production fluid, through the wellbore 214. The casing string 212 may comprise one or more openings 218 which lead to lateral bores 220. The tubular string may comprise one or more aligning tools 216 associated with one or more of the openings 218. The aligning tools 216 may be coupled with the interior wall of a tubular string, such as casing string 212 or formed in the radius of the casing string 212, so that each of the openings 218 has an aligning tool 216 positioned adjacent to the corresponding openings 218. In an embodiment, each aligning tool 216 may be positioned along the tubular string above, below, and/or next to its associated opening 218. The aligning tool(s) 216 may comprise an inclined upper surface, which may be similar to a device known as a muleshoe. The inclined upper surface provides a surface to at least rotationally orient (e.g., radially align or orient) a wellbore tubular string within a wellbore and/or wellbore casing string relative to an opening leading to a lateral bore.

Figure 3A:
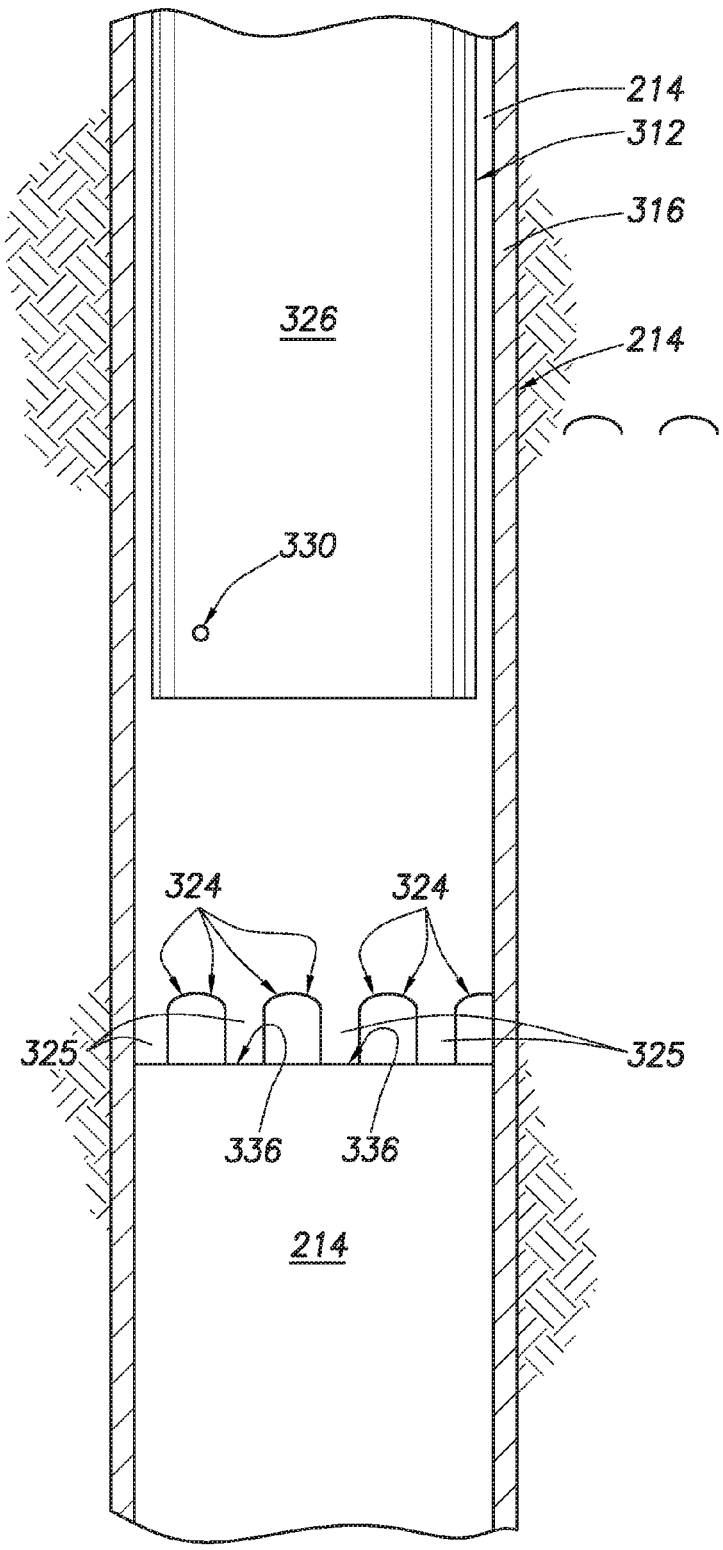
FIGS. 3A and 3B are cross-sectional views of an embodiment of a wellbore tubular orientation system.

In some embodiments, different structures may be used to rotationally align the window in the tubular string 312 with an opening in the casing and longitudinally align the window with the opening in the casing. A longitudinal alignment mechanism is schematically illustrated in FIG. 3A. As shown in FIG. 3A, a tubular string 312 is disposed within a casing string bore 314 formed by a casing string 316 disposed in a wellbore 214. The tubular string 312 may define a tubular string bore 326 configured to communicate fluid, such as production fluid. The wellbore tubular string 312 may comprise one or more tubular aligning tools 330 configured to engage a corresponding holder 336 and retain the tubular string 312 in a longitudinal position. In some embodiments, the tubular aligning tools 330 may also prevent rotational movement when the tubular string 312 is retained in a longitudinal position. The tubular aligning tool 330 may be coupled to the outer surface of and/or form a portion of the wellbore tubular string 312. The tubular aligning tool 330 could also be a component of a mule-shoe like device that would align and set in a holder 336 such as a no-go shoulder. The tubular aligning tool 330 may comprise a collet, indicator, lug, and/or the like. For example, the tubular aligning tool 330 may comprise one or more lugs extending radially from the tubular string 312. The lug(s) may be configured to engage a holder 336, such as a no-go shoulder, to retain the tubular string 312 in a longitudinal position along the wellbore 214. In an embodiment, the holder 336 may comprise a no-go shoulder with a seat which is configured to engage the lug. When the tubular string 312 is moved down through the wellbore 214, the lug may engage the no-go shoulder preventing the tubular string 312 from further movement down the wellbore. In an embodiment, the tubular string 312 may be substantially aligned so that when the tubular string moves longitudinally through the wellbore 214, the tubular aligning tool 330 may not engage the aligning tool 324 before coming to rest on the no-go shoulder.

As shown in FIG. 3A, the holder 336 may sit at the base of a plurality of slots 325 with a plurality of aligning tools 324 in the form of angled edges angling towards the slots 325. When the tubular string 312 moves longitudinally down the wellbore 214, the tubular string 312 may first be rotationally aligned by a separate structure above and/or below the holder 336, as described in more detail below. The tubular aligning tool 330 may be closely aligned with one of the slots 325 as it moves downward. However, the tubular aligning tool 330 may not be perfectly aligned with the slots 325. The tubular aligning tool 330 may engage the aligning tool 324 so that the aligning tool 324 guides the tubular aligning tool 330 into one of the slots 325 aligning the tubular string 312 in the wellbore 214. Once in position, the engagement of the lugs 330 with the slots 325 may prevent both further downward movement of the tubular string 312 as well as rotation motion of the tubular string 312 about the longitudinal axis of the tubular string 312.

Figure 3B:
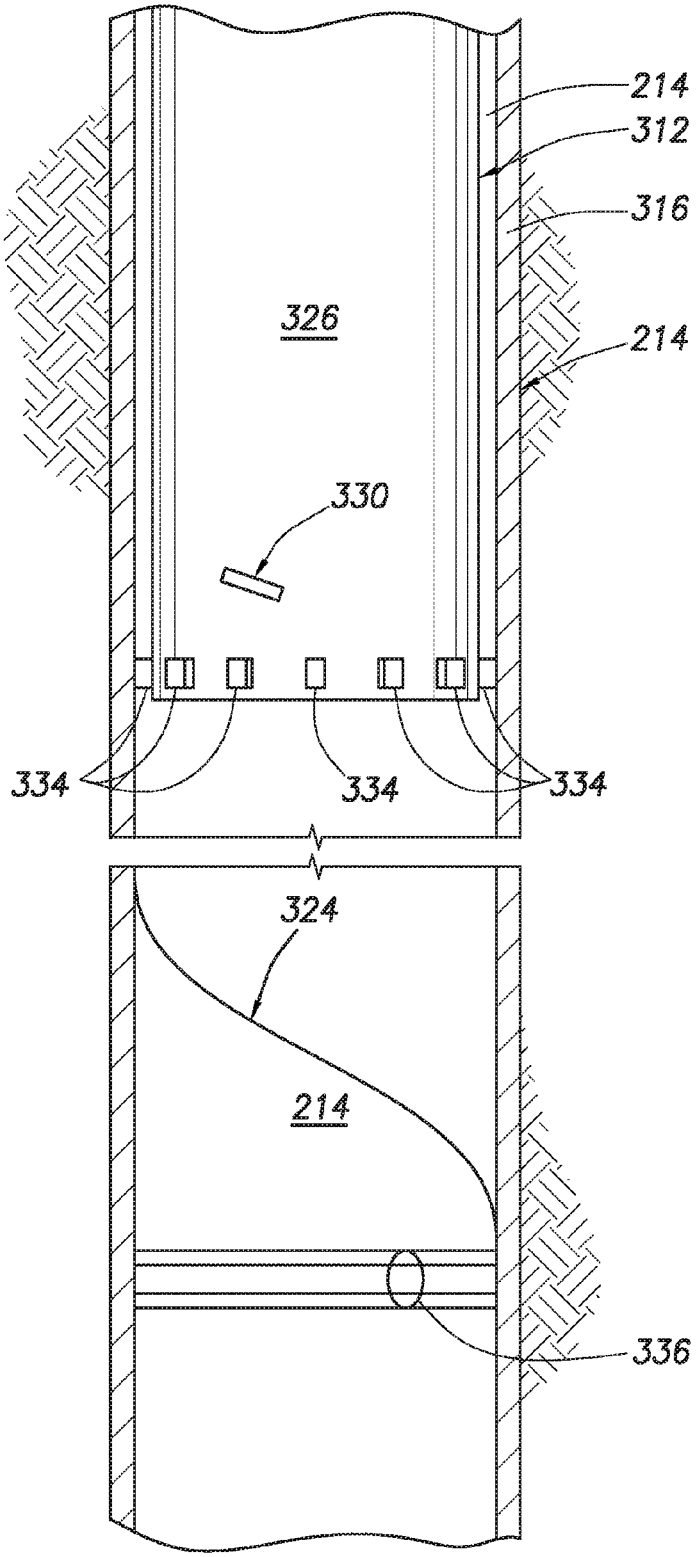

FIG. 3B depicts a tubular string 312 disposed within a casing string bore 314 formed by a casing string 316 disposed in a wellbore 214, wherein the casing string 316 may comprise one or more aligning tools, such as aligning tool 324. The tubular string 312 may define a tubular string bore 326 configured to communicate fluid, such as production fluid. The wellbore tubular string 312 may comprise one or more tubular aligning tools 330 configured to radially align the tubular string 312 for example by engaging an aligning tool 324 and/or a holder 336. In an embodiment, the tubular aligning tool 330 may comprise one or more lugs extending radially from the tubular string 312. The lug(s) may be configured to engage an aligning tool 324, such as a declining seat, to align the tubular string 312 in a radial position within the wellbore 214. For example, as shown in FIG. 3B, the aligning tool 324 may comprise a decline seat which engages the inner wall of the casing string 316. The tubular aligning tool 330 may also be configured to engage the aligning tool 324 at the seat. When the tubular string 312 is moved down through the wellbore 214, the tubular aligning tool 330 may engage the seat of the aligning tool 324. As the tubular string 312 continues to move down the wellbore 214 while the tubular aligning tool 330 engages the seat of the aligning tool 324, the tubular string 312 may align within the wellbore 214.

As previously discussed, as the tubular string 312 displaces longitudinally down along the wellbore 214 away from the surface, the engagement between the tubular aligning tool 330 and the aligning tool 324 causes the tubular string 312 to rotate, thereby rotationally aligning the tubular string 312 within the wellbore 214. The length of the aligning tool 324 or the distance along the seat of the aligning tool 324 where the tubular aligning tool 330 initially engages the seat to the lowest point of the seat with the wellbore tubular 214 (i.e. further away from the surface) which supports tubular aligning tool 330 may determine how much the tubular string 312 rotates relative to the wellbore 214 in order to align the tubular string 312 within the wellbore 214. In an embodiment, the tubular string 312 may rotate no more than about 360°, no more than about 350°, no more than about 340°, no more than about 330°, no more than about 320°, no more than about 310°, no more than about 300°, no more than about 290°, no more than about 280°, no more than about 270°, no more than about 260°, no more than about 260°, no more than about 240°, no more than about 230°, no more than about 230°, no more than about 210°, no more than about 200°, no more than about 190°, no more than about 180°, no more than about 170°, no more than about 160°, no more than about 150°, no more than about 140°, no more than about 130°, no more than about 120°, no more than about 110°, no more than about 100°, no more than about 90°, no more than about 80°, no more than about 70°, no more than about 60°, no more than about 50°, no more than about 40°, no more than about 30°, and no more than about 20°. In some embodiments, the tubular string 312 may be configured to rotate no more than about 180°. Regardless of how much, if any, the tubular string 312 may rotate, the engagement between the aligning tool 324 and the tubular aligning tool 330 may align the tubular string 312 so that a tubular string opening at least partially aligns with an opening in the casing.

FIG. 3B also depicts one or more holding devices 334 configured to prevent at least rotational displacement and/or at least axial displacement of the tubular string 312, for example, so that tubular string 312 does not misalign (e.g., rotate out of alignment) after being aligned. In an embodiment, the holding devices 334 unique to the holders 336 associated with particular casing string openings 220 to lateral bores may also be used with the above embodiments. Holders 336 formed along the interior surface of the casing string 316 may align with and receive movable, spring loaded, holding devices 334 such as a series of latches and/or collets extending radially from the tubular string 312. In some embodiments, the holding device(s) 334 may comprise a solid shoulder sized to engage the holders 336. Holders 336 may comprise seats, protrusions, recesses, and/or the like. After the tubular aligning tool 330 engages with the aligning tool 324 and the tubular string 312 is displaced down the wellbore 314 until the casing string 316 is at least partially aligned within the wellbore 214, the holding device 334 may properly align axially and rotationally with appropriate holder(s) 336 in the casing string 316. In an embodiment, during aligning of the holding devices 334, the spring loading on the holding devices 334 may force the holding devices 334 to move radially outwardly into mating forms in the holder(s) 336.

In an embodiment, the holding device 334 pattern may be configured so that the holding device 334 may fit into a plurality of holders 336, such as the recesses, along the casing string. In an embodiment, holding device patterns or individual holding devices 334 may be specific or unique for particular holders 336 acting as a key so that the holding device only mates with one or more specific holders 336. In an embodiment, the holding devices 334 may mate with the holders 336 due to the relative diameters of the casing string bore 332 and the tubular string 312. For example, the holding devices 334 may only mate with holders 336 at a particular longitudinal area of the casing string bore 332 due to a decrease in casing string bore diameter. Mating a holding device 334 and holder 336, such as a recess, after at least partially radially aligning and/or at least partially longitudinally aligning a tubular string 312 retains the tubular string 312 in at least partial alignment with the wellbore 214. In some embodiments, the holding device 334 comprises keyless latches. Examples of keyless latches are described in more detail in U.S. Pat. No. 5,579,829, the entire disclosure of which is incorporated herein by reference.

Figure 4:
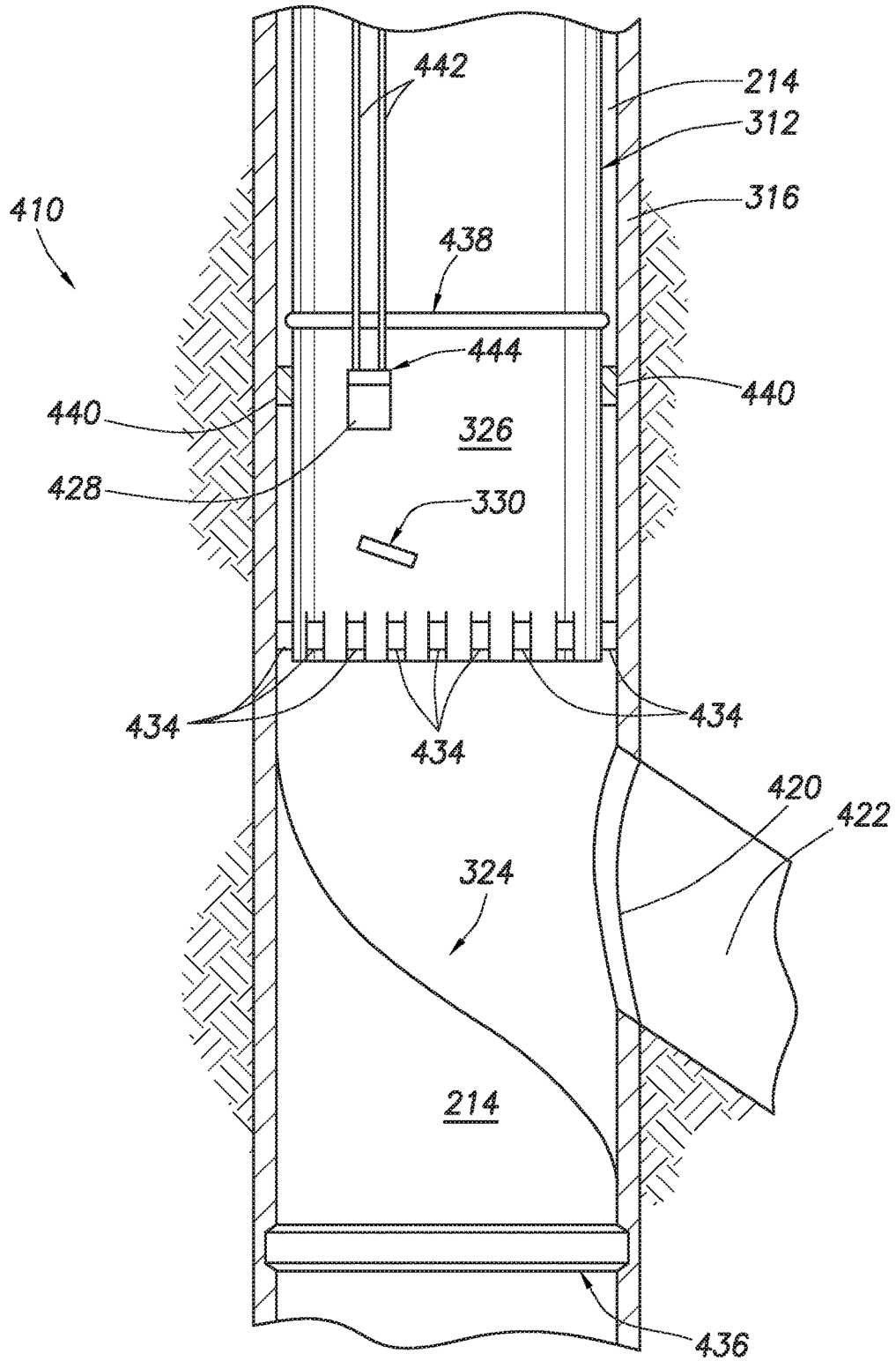
FIG. 4 is a cross-sectional view of an embodiment of a wellbore tubular orientation system.

FIG. 4 depicts a wellbore tubular orientation system 410 similar to the embodiments disclosed in FIGS. 3A and 3B. Additionally, the wellbore tubular orientation system 410 may comprise one or more reference indicators 438. Reference indicators 438 may indicate when the tubular string opening 428 is in a position to begin aligning with a casing string opening 420 to a lateral bore 422. For example, the indicators 438 may provide a depth or position indicator. In an embodiment, the reference indicator 438 may indicate just before the tubular aligning tool 330 engages with the casing aligning tool 324. For example, the tubular string 312 may be disposed in the casing string bore 332 and displaced along the wellbore 214. The tubular string 312 may comprise the reference indicator 438 which engages with a nodule 440 which impedes and/or resists further displacement of the tubular string 312 down the wellbore 214. By impeding and/or resisting further displacement of the tubular string 312 down the wellbore 214, the reference indicator 438 indicates that the tubular string opening 428 is above an associated casing string opening 420 to a lateral bore 422. For example, one or more individuals (e.g. operators) located at the surface of the wellbore 214 may detect additional resistance to the displacement of the tubular string 312 down the wellbore 214 and increase the downward force on the tubular string 312 which overcomes the additional resistance. By overcoming the resistance with a particular increase in additional downward force on the tubular string 312, the individuals at the surface may identify that the tubular string is about to be aligned within the wellbore 214. Suitable indicators 438 may include those described in U.S. Pat. No. 8,453,728 entitled "Apparatus and Method for Depth Referencing Downhole Tubular Strings," which is incorporated herein by reference in its entirety.

In another example, the tubular string 312 may be disposed in the casing string bore 332 and displaced along the wellbore tubular 214. The tubular string 312 may engage a reference indicator 438 which can provide an indication that the tubular string opening 428 is above an associated casing string opening 420 to a lateral bore 422. The tubular string 312 may be stopped by the reference indicator 438 from further axial displacement until tubular string opening 428 is ready for aligning with the casing string opening 420 to the lateral bore 422.

The reference indicator 438 may comprise one or more shear pins, one or more malleable notches, one or more shear rings, one or more sensor, one or more collet indicators configured to engage with a corresponding indicator, one or more sets of latch couplings and latch keys, and/or the like. For example, the reference indicator 438 may comprise a set of latch couplings radially disposed along the casing string 316 and a set of latch keys disposed with the tubular string 312. The set of latch keys may be configured to receive the set of latch couplings and secure the tubular string 312 to a particular position along the wellbore 214 and/or indicate the axial position of the tubular string opening 428 within the wellbore 214. In an embodiment, the reference indicator 438 may be configured to indicate only when a particular tubular string opening is in a position to be aligned with a particular opening to a lateral bore. For example, the reference indicator 438 may comprise a collet indicator or a key with a unique patterns and orientation. The reference indicator 438 and an associated tubular string opening 428 may be disposed down the wellbore 214 and pass several openings to lateral bores not designated for the particular reference indicator and tubular string opening. Thus, no indication or a minor resistance will be given by the reference indicator just before the tubular string opening associated with the reference indicator begins to axially pass the openings to the lateral bores. However, as the tubular string 312 is disposed further down the wellbore 318, the reference indicator 338 and the tubular string opening 428 may approach a casing string opening 420 to a lateral bore 422 designated for that tubular string opening 428. The uniquely configured collet may engage a recess uniquely configured to receive the collet indicator or key impeding and/or resisting further displacement of the tubular string 312 down the wellbore 214. When the tubular string opening 428 is ready for aligning with the designated casing string opening 420 to the lateral bore 422, a force to overcome the retaining force of the collet and housing may be provided to the wellbore 214 to begin the aligning.

In an embodiment, the wellbore tubular orientation system 410 may also comprise one or more control lines 442 used for a variety of purposes within the wellbore. For example, the control lines may comprise fluid lines providing fluid pressure to various controllable devices (e.g., valves, actuators, pistons, setting devices, etc.) and/or provide fluid to a location within the wellbore (e.g., for use in chemical injection). In some embodiments, the control lines may comprise electrical lines, fiber optic lines, and the like and may be used for various purposes including actuating various tools, measuring one or more parameters in the wellbore, providing communication within the wellbore, treating the wellbore, etc. The control lines can generally be run along the tubular string either inside or outside the tubular components, and the control lines can be coupled to the tubular string by one or more connection devices such as straps or connectors. Rotation of the tubular string can generally result in a lengthening of the control lines coupled to the tubular string, potentially damaging the control lines if the length is extended beyond the available slack in the control lines. The wellbore tubular orientation system 410 may be configured to limit the total amount of rotation of the tubular string to avoid damaging one or more control lines.

In some embodiments, the control lines 442 may be coupled to one or more valves 444 associated with one or more tubular string openings 428, one or more casing string openings 420, and/or one or more lateral bores 422. The control lines 442 may be configured to selectively actuate the valves 444 between an open and closed position. For example, the valve(s) 444 may comprise a piston configured to receive a portion of control fluid used to actuate the valve(s) 444. While the following discussion describes a tubular string 312 with a valve 444, it should be understood that any plurality of valves 444 and/or any plurality of piston assemblies may be used in one or more tubular string 312 to achieve the results and advantages described herein.

In an embodiment illustrated in FIG. 4, the valve(s) 444 is positioned with the tubular string 312. One or more control line(s) 442 extend along the tubular string 312 and are coupled to the valve 444. The control line 442 provides a control fluid to the valve 444 to actuate the valve 444 between an open position and a closed position, and in some embodiments may be used to selectively regulate the valve position between the open and closed positions. For example, in some embodiments, the valve may be used to regulate flow within the wellbore. In an embodiment, the control line 442 comprises a hydraulic control line. Pressure can be applied to the control line 442 from a remote location (e.g., the surface) to actuate the valve 444. In an embodiment, the valve 444 may be biased closed so that a pressure supplied through the control line above a threshold opens the valve, and a pressure below the threshold actuates the valve 444 to the closed position. Though the control line 442 is depicted in FIG. 4 as being external to the tubular string 312, it will be appreciated that any control line may be used to convey actuation pressure to the valve 444. For example, the control line 442 could be internal to the tubular string 312, or formed in a sidewall of the tubular string. The actuation pressure could be generated by a pump or other pressure generation device in fluid communication with the control line 442.

The valve(s) 444 may be actuated for example in coordination with the alignment of a tubular string opening 428 and a casing string opening 420 leading to a lateral bore 422 for example to control fluid communication from a lateral bore 422. For example, when operatively installed in a well, the control line(s) 442 may extend to the earth's surface and may be conventionally secured to the tubular string 312 with, for example, connection members at suitable intervals. After the tubular string opening 428 at least partially aligns with a casing string opening 420 to a lateral bore 422, fluid pressure may be applied through the control line(s) 442. When fluid pressure has been applied to the control line(s) 442, a piston disposed in fluid communication with the pressured fluid may be forced to displace axially. Fluid pressure driving the piston may cause displacement of the piston actuating one or more valve(s) 444 open and/or closed. By actuating the one or more valve(s) 444 associated with one or more casing string openings 420 to lateral bores 422, fluid communication can be controlled from the lateral bore 422, for example, to the wellbore 214.

In general, the wellbore tubular orientation system 410 may be configured at the surface to provide the appropriate relative rotational and axial alignments for a plurality of windows in the tubular string 312 with the windows in the casing. However, an exact alignment and spacing is often difficult to achieve and may only be known within some degree of error. Thus, tolerances can be built into the wellbore tubular orientation system 410 to allow for an adjustment of the axial and/or rotational alignment of the windows in the tubular string 312 with the windows in the casing.

Figure 5:
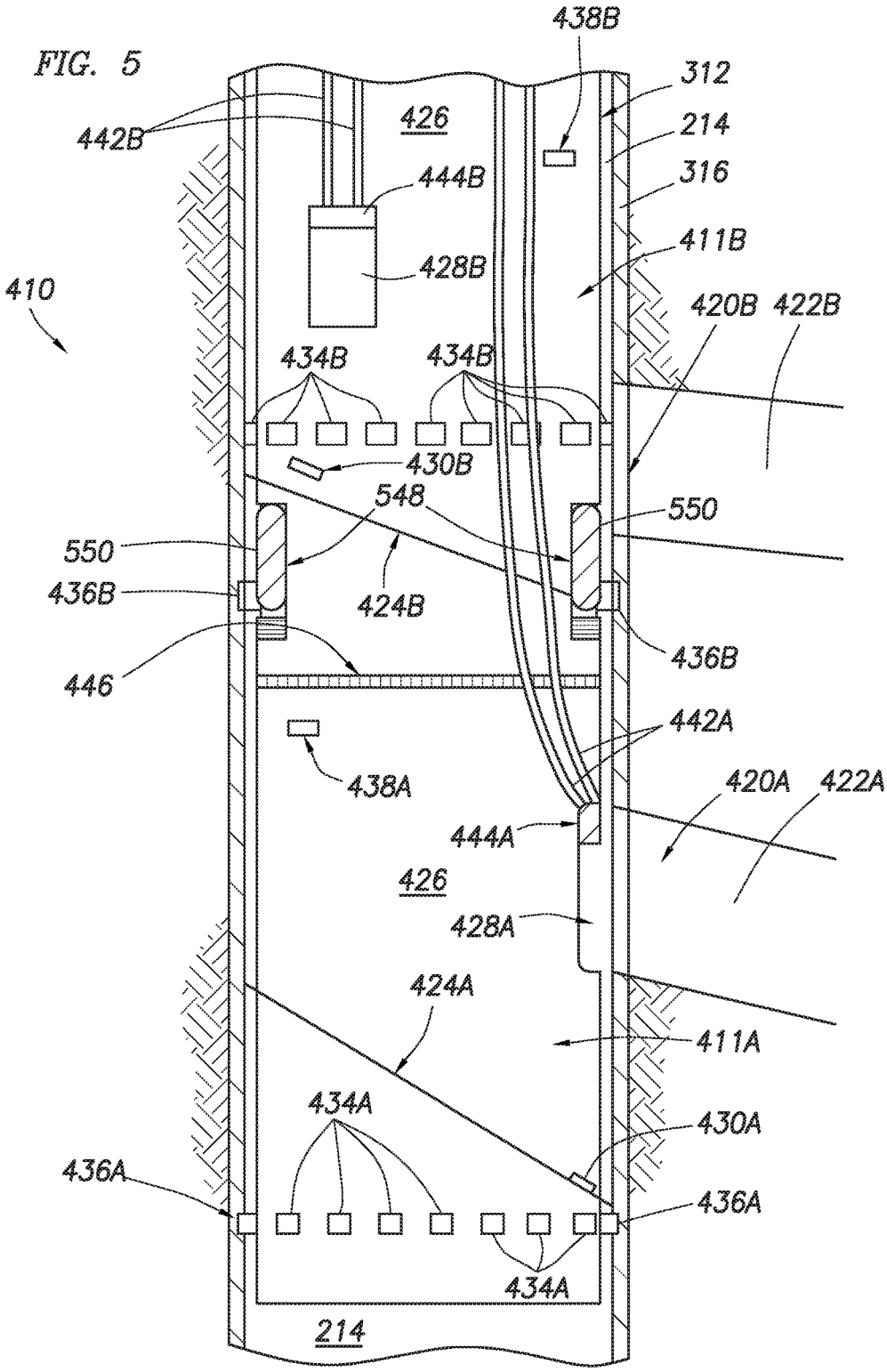
FIG. 5 is a cross-sectional of an embodiment of a wellbore tubular orientation system.

An embodiment of a system providing for adjustment of the alignment within the wellbore is illustrated in FIG. 5. As shown, the wellbore tubular orientation system 410 can include a tubular string 312 disposed within a casing string bore 414 formed by a casing string 416 disposed in a wellbore 214. The wellbore tubular orientation system 410 may comprise a first casing string opening 420A, which leads to a first lateral bore 422A, as well as, a first casing aligning tool 424A associated with the first casing string opening 420A. The wellbore tubular orientation system 410 may also comprise a second casing string opening 420B, which leads to a second lateral bore 422B, as well as, a second casing aligning tool 424B associated with the second casing string opening 420B. The wellbore tubular orientation system 410 may also comprise a coupled tubular string 412 defining a tubular string bore 426 configured to communicate fluid, such as production fluid. The coupled tubular string 412 may comprise at least a first tubular string portion 411A and a second tubular string portion 411B. The first tubular string portion 411A may be coupled at a coupling 446 to the second tubular string portion 411B so that the first tubular string portion 411A may rotate independently from the second tubular string portion 411B, though one or more additional sections may be disposed between the first tubular string portion 411A and the second tubular string portion 411B. In an embodiment, the first tubular string portion 411A and/or the second tubular portion 411B may comprise a flexible pipe. In an embodiment, the first tubular string portion 411A may also be coupled to the second tubular string portion 411B so that the first tubular string portion 411A and the second tubular string portion 411B form a continuous coupled tubular string bore 426. The first tubular string portion 411A may be disposed into the wellbore first followed by the second tubular string portion 411B, as shown, such that the first tubular string portion 411A is below the second tubular string portion 411B. Similar to previous embodiments, the first tubular string portion 411A may comprise a first tubular aligning tool 430A, a first tubular string opening 428A configured to radially align with a first casing string opening 420A, a first set of one or more holding device(s) 434A configured to prevent at least rotational displacement and/or axial displacement of the first tubular string portion 411A and configure to be received by a first set of one or more holder(s) 436A. In an embodiment, the first tubular string portion 411A may also comprise a first set of one or more reference indicator(s) 438A and first set of one or more nodules. Additionally, similar to previous embodiments, the second tubular string portion 411B may comprise a second tubular aligning tool 434B, a second tubular string opening 428B configured to radially align with a second casing string opening 420B, a second set of one or more holding device(s) 434B configured to prevent at least rotational displacement and/or axial displacement of the second tubular string portion 411B and configured to be received by a second set of one or more holder(s) 436B. In an embodiment, the second tubular string portion 411B may also comprise a second set of one or more reference indicator(s) 438B and second set of one or more nodules.

In use, the first tubular string portion 411A may be displaced into the wellbore 214. Similar to previous embodiments, the first tubular aligning tool 430A may engage with the first casing aligning tool 424A so that the first tubular string portion 411A rotates. The engagement between the first casing aligning tool 424A and the first tubular aligning tool 430A may cause the first tubular string portion 411A to rotate until the first tubular string opening 428A has at least partially aligned with the first casing string opening 420A leading to a first lateral bore 422A. The first tubular string portion 411A may rotate independently of the second tubular string portion 411B and in an embodiment, subsequent tubular string portion above the second tubular string portion. Additionally, when the first tubular string portion 411A rotates until the first tubular string opening 428A at least partially aligned with the first casing string opening 420A leading to first lateral bore 422A, the first set of one or more holding device(s) 434A may be received by the first set of one or more holders 436A. The reception of the first set of one or more holding device(s) 434A by the first set of one or more holders 436A prevents at least rotational displacement and/or axial displacement of the first tubular string portion 411A. For example, the first set of one or more holding device(s) 434A may be configured to receive only the first set of one or more holders 436A and/or may not be configured to receive the second set of one or more holders 436B. Thus, as the first set of one or more holding device(s) 434A may pass the second set of one or more holders 436B, the first set of one or more holding devices 434A may not receive the second set of one or more holders 436B. Then when the first tubular aligning tool 430A engages the first casing aligning tool 424A and the first tubular string opening 428A at least partially aligns with the first casing string opening 420A, the first set of one or more holding device(s) 434A may align with the first set of one or more holders 436A and receive the first set of one or more holders 436A preventing at least rotational displacement and/or axial displacement of the first tubular string portion 411A.

In an embodiment, a first set of one or more reference indicator(s) 438A, may maintained the first tubing string portion 411A in a first position indicating that the first tubular string opening 428A is in a position for aligning with the first casing string opening 420A. In an embodiment, a first set of one or more reference indicator(s) 438A, may have maintained the first tubing string portion 411A in a first position indicating that the first tubular aligning tool 430A is about to engage with the first casing aligning tool 424A. For example, the first set of one or more reference indicator (s) 438A may be configured to indicate that the first tubular string opening 428A is in a position for aligning only with the first casing string opening 420A or may not be configured to indicate that first tubular string opening 428A is above the second casing string opening 420B to a second lateral bore 422B. Thus, as the first tubular string 411A and the first set of one or more reference indicator(s) 438A approaches the second casing string opening 420B and/or the second casing aligning tool 424B, the first set of one or more reference indicator(s) 438A may not provide any indication that the first tubular string portion 411A is approaching the second casing string opening 420B. Furthermore, when the first tubular string portion 411A and the first set of one or more reference indicator(s) 438A approaches the first casing string opening 420A and/or the first tubular aligning tool 430A is about to engage the first casing aligning tool 424A, the first set of one or more reference indicator(s) 438A may indicate such, for example, by providing a resistance to movement and/or by holding the first tubular string portion 411A in a stationary position, such as a temporary stationary position which may be overcome by applying an axial force above a threshold. In an embodiment, the first set of one or more reference indicator(s) 438A may indicate when the first tubular string portion 411A approaches the second casing string opening 420B as well as the first casing string opening 420A so that first reference indicator(s) 438A and second reference indicators 438B may indicate how far down the wellbore tubular 418 a tubular string portion is located.

In an embodiment, the first tubular string portion 411A and the second tubular string portion 411B may also comprise one or more control lines for actuating one or more valves. A first valve 444A associated with first tubular string opening 428A, a first casing string opening 420A, and/or the first lateral bore 422A may be actuated by a first set of one or more control lines 442A. The first set of one or more control lines 442A may be configured to actuate the first valve 444A between an open and closed position. The first valve 444A may be configured to control fluid communication from the first lateral bore 422A. For example, the first set of one or more control lines 442A may extend at least from the first tubular string opening 428A, along the first tubular string portion 411A and the second tubular string portion 411B, and to the earth's surface. In an embodiment, the first set of one or more control lines 442A may extend from the first lateral bore 422A where the first valve 444A may be located. The first set of one or more control lines 442A may be conventionally secured to the first tubular string portion 411A and the second tubular string portion 411B with, for example, connection members at suitable intervals. After the first tubular string opening 428A at least partially aligns with the first casing string opening 420A to the first lateral bore 422A, fluid pressure may be applied to the first set of one or more control lines 442A. When fluid pressure has been applied to the first set of one or more control lines 422A, a piston disposed in fluid communication with the pressured fluid may be forced to displace axially. Fluid pressure may drive the piston causing displacement of the piston actuating the first valve 444A open and/or closed. By actuating the first valve 444A associated with first casing string opening 420A to the first lateral bore 422A, fluid communication can be controlled from the first lateral bore 422A, for example, to the wellbore 418 and/or the casing string bore 432. It should be understood, that although a first valve 444A is described above, a plurality of first valves 444A may be used with one or more first tubular string openings 428A and/or with one or more first lateral bores 422A associated with first tubular string openings 428A.

In an embodiment, the tubular string may comprise at least one telescoping device 548 disposed between the first tubular string opening 428A and the second tubular string opening 428B. The telescoping device 548 may be configured to change the distance between the first tubular string opening 428A and the second tubular string opening 428B such that when the telescoping device 548 is contracted the distance between the first tubular string opening 428A and the second tubular string opening 428B is no greater than the distance between the first casing string opening 420A and the second casing string opening 420B. Furthermore, the telescoping device 548 may be configured so that when the telescoping device 548 is extended, the distance between the first tubular string opening 428A and the second tubular string opening 428B is greater than the distance between the first casing string opening 420A and the second casing string opening 420B. In an embodiment, the telescoping device 548 may be biased towards the extended position, for example, by a biasing member 550 such as a spring, a compressible cavity, and/or the like. For example, at least the first tubular string portion 411A may be disposed into the wellbore 418 and the first set of one or more holding device(s) 434A may be received by the first set of one or more holder(s) 436A holding the first tubular string opening 428A in at least partial alignment with a first casing string opening 420A. The telescoping device 548 may be biased towards the extended position so that distance between the first tubular string opening 428A and the second tubular string opening 428B is greater than the distance between the first casing string opening 420A and the second casing string opening 420B. Thus, because the telescoping device 548 is in the extended position and the first tubular string opening 428A is at least partially aligned with the first casing string opening 420A, the second tubular string opening 428B is above the second casing string opening 420B and misaligned with the second casing string opening 420B. Furthermore, the second tubular string portion 411B may also be disposed in the wellbore 418. The second tubular string opening 428B may then be disposed down through the wellbore 418 by applying an axial force to the coupled tubular string 412. As an axial force is applied to the coupled tubular string 412, the first set of one or more holding device(s) 434A received by the first set of one or more holder(s) 436A limits and/or prevents the first tubular string portion 411A from further displacement down the wellbore 418 and/or from radial misaligning the first tubular string opening 428A with the first casing string opening 420A. Thus, because the first tubular string portion 411A is limited and/or prevented from further displacement down the wellbore 418, the axial force applied to the coupled tubular string 412 causes the telescoping device 548 to contract, compressing the biasing member 550 so that the distance between the first tubular string opening 428A and the second tubular string opening 428B begins to reduce to provide the appropriate space out of the openings.

Figure 6:
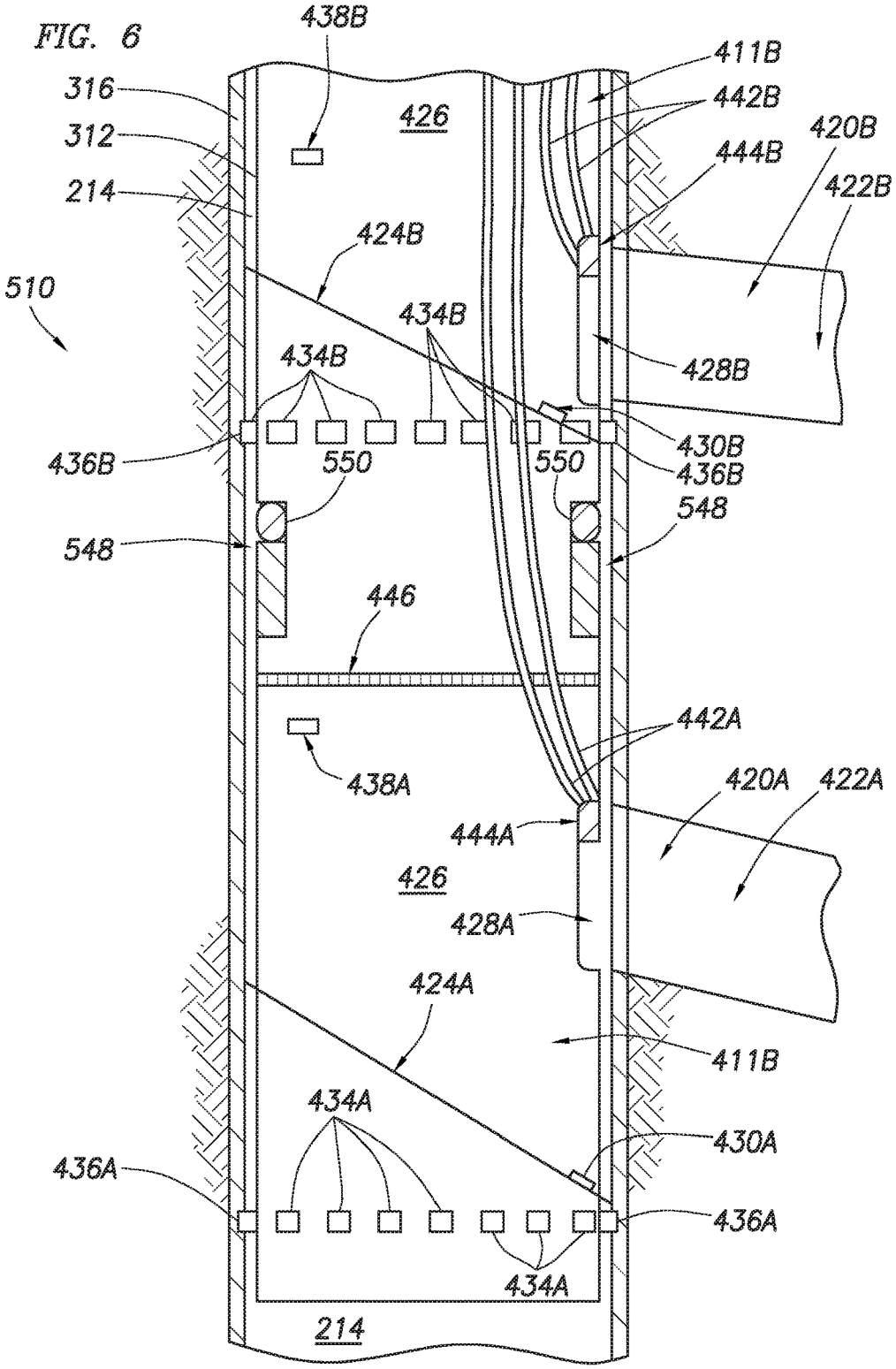
FIG. 6 is another cross-sectional of an embodiment of a wellbore tubular orientation system.

FIG. 6 depicts an embodiment of the wellbore tubular orientation system 510 when the telescoping device 548 has contracted. The telescoping device 548 has contracted so that the biasing member 550 has compressed and distance between the first tubular string opening 428A and the second tubular opening 428B may be substantially the same as the distance between the first casing string opening 420A and the second casing string opening 420B. Additionally, the second tubular aligning tool 430B has engaged the second casing aligning tool 424B and rotated the second tubular string portion 411B so that the second tubular string opening 428B may be at least partially aligned with the second casing string opening 420B. The rotation of the second tubular string portion 411B may be in the same direction or a different direction than the first tubular string portion 411A. The ability to rotate the tubular string portions 411A, 411B in different directions may help to limit the total rotation of the tubular string. The second tubular string portion 411B may rotate independently of the first tubular string portion 411A and in an embodiment, subsequent tubular string portion above the second tubular string portion 411B. Furthermore, when the second tubular string portion 411B has rotated so that the second tubular string opening 428B is at least partially aligned with the second casing string opening 420B leading to a second lateral bore 422B, the second set of one or more holding device(s) 434B were received by the second set of one or more holder(s) 436B. The reception of the second set of one or more holding device(s) 434B by the second set of one or more holder(s) 436B prevents at least rotational displacement and/or axial displacement of the second tubular string portion 411B. For example, the second set of one or more holding device(s) 434B may have been configured to be received by only the second set of one or more holder(s) 436B and/or may have not been configured to be received by a subsequent set of one or more recesses (located above the second set of recesses). Thus, as the second set of one or more holding device(s) 434B passes the subsequent set of one or more recesses, the second set of one or more holding device(s) 434B may not be received by the subsequent set of one or more recesses. Then when the second tubular aligning tool 430B engages the second casing aligning tool 430B and the second tubular string opening 428B at least partially aligns with the second casing string opening 420B, the second set of one or more holding device(s) 434B may align with the second set of one or more holder(s) 436B and may be received by the second set of one or more holder(s) 436B preventing at least rotational displacement and/or axial displacement of the second tubular string portion 411B. In an embodiment, the second set of one or more holding device(s) 434B may be generic so that any set of recesses may receive them. This may be applicable, for example, when the second tubular string portion 411B is the last (i.e. the closest to the surface) tubular string portion disposed in the wellbore 418.

In an embodiment, a second set of one or more reference indicator(s) 438B may have maintained the second tubing string portion 411B in a position indicating that the second tubular string opening 428B is in a position for aligning with the second casing string opening 420B. In an embodiment, a second set of one or more reference indicator(s) 428B may have maintained the second tubing string portion 411B in a position indicating that the second tubular aligning tool 430B is about to engage with the second casing aligning tool 424B. For example, the second set of one or more reference indicator(s) 438B may be configured to indicate that the second tubular string opening 428B is in a position for aligning only with the second casing string opening 420B or may not be configured to indicate that second tubular string opening 428B is above a subsequent casing string opening located above the second casing string opening 420B to the second lateral bore 422B. Thus, as the second tubular string portion 411B and the second set of one or more reference indicator(s) 438B approaches a subsequent casing string opening, the second set of one or more reference indicator(s) 438B may not provide any indication that the second tubular string portion 411B is approaching a subsequent casing string opening. Furthermore, when the second tubular string portion 411B and the second set of one or more reference indicator(s) 438B approaches the second casing string opening 420B and/or the second tubular aligning tool 430B is about to engage the second casing aligning tool 424B, the second set of one or more reference indicator(s) 438B may indicate such, for example, by holding the second tubular string portion 411B in a stationary position, such as a temporary stationary position which may be overcome by applying an axial force above a threshold. In an embodiment, the second set of one or more reference indicator(s) 438B may indicate when the second tubular string portion 411B approaches a subsequent casing string opening so that reference indicators may indicate how far down the wellbore tubular 418 a tubular string portion is located.

In an embodiment, the second tubular string portion 411B may also comprise one or more control lines 442B for actuating one or more second valves 444B. A second valve 444B associated with second tubular string opening 428B, a second casing string opening 420B and/or the second lateral bore 422B associated with the second tubular string opening 428B may be actuated by a second set of one or more control lines 442B. The second set of one or more control lines 442B may be configured to actuate the second valve 444B between an open and closed position. The second valve 444B may be configured to control fluid communication from the second lateral bore 422B. For example, the second set of one or more control lines 442B may extend from the second tubular string opening 428B, along the second tubular string portion 411B, and to the earth's surface. Additionally, as previously described, the first set of one or more control lines 442A may also extend from the first tubular string opening 428A along the first tubular string portion 411A and the second tubular string portion 411B, and to the earth's surface. In an embodiment, the second set of one or more control lines 442B may extend from the second valve 444B disposed in the second lateral bore 422B. The second set of one or more control lines 442B may be conventionally secured to the second tubular string portion 411B with, for example, straps at suitable intervals. After the second tubular string opening 428B at least partially aligns with the second casing string opening 420B, fluid pressure may be applied to the second set of one or more control lines 442B at the earth's surface with a pump. When sufficient fluid pressure has been applied to the second set of one or more control lines 442B, a piston axially slidingly disposed in fluid communication with the pressured fluid may be forced to displace axially. Fluid pressure may drive the piston causing displacement of the piston actuating the second valve 444B open and/or closed. By actuating the second valve 444B associated with the second casing string opening 420B, fluid communication can be controlled from the second lateral bore 422B, for example, to the wellbore 418. It should be understood, that although a second valve is described above, a plurality of second valves may be used with one or more second tubular string openings and/or with one or more lateral bores associated with second tubular string openings.

The independent rotation of each tubular string portion caused by the engagement of the tubular aligning tools and the casing aligning tools may limit the stress on the control lines disposed along the tubular string portions. For example, when the first tubular string portion 411A has been locked into position by the engagement of the first holding device 434A and the first holder 436A so that the first tubular string opening 428A is at least partially aligned with the first casing string opening 420A, the second tubular string portion 428A may rotate due to the engagement of the second tubular aligning tool 430A and the second casing aligning tool 424A. Because the first tubular string portion 411A is locked into position as the second tubular string portion 411B rotates, less stress is generated on the control lines disposed along the first tubular string portion 411A and/or the second tubular string portion 411B, thereby decreasing the probability that one or more control lines are damaged and/or broken.

In an embodiment, a method for orienting a tubing string in a wellbore is disclosed. Initially, a tubular string may be lowered within a casing string into a wellbore. The tubular string may be lowered thereby displacing the tubular string into a position such that the tubular string opening is not at least partially aligned with the casing string opening. The tubular string may also be lowered to thereby displace the tubular string into a position such that the tubular string aligning tool has not engaged with the casing string aligning tool. Additionally, the tubular string may be lowered to thereby displace the tubular string out of the position by applying a force to release the tubular string. The tubular string may comprise a tubular string opening and a tubular string aligning tool. The tubular aligning tool may engage with a casing aligning tool while lowering the tubular string. The tubular string may be rotated in response to engaging the tubing aligning tool with the casing aligning tool. In an embodiment, the tubular string may rotate no more than 360 degrees. The tubular string opening may rotationally align with a casing string opening disposed through the casing string based on the rotating. The tubular string opening may be retained in an axial alignment and a rotational alignment with the casing string opening. The valve may be actuated when the tubular string opening is at least partially aligned with the casing string opening to provide fluid communication with the casing string opening.

In an embodiment, a method for orienting a tubular string in a wellbore is disclosed. The tubular string can be lowered within a casing string in a wellbore. The tubular string may comprise a first tubular string portion and a second tubular string portion. The first tubular string portion may comprise a first tubular string opening and a first tubular aligning tool. The second tubular string portion may comprise a second tubular string opening and a second tubular aligning tool. The second tubular string portion may comprise a second tubular string opening and a second tubular aligning tool. The tubular string may comprise a third tubular string portion. The third tubular string portion may comprise a third tubular string opening and a third tubular aligning tool. The first tubular string portion may be disposed below the second tubular string portion. The method may also comprise that the first tubular aligning tool is engaged with a first casing aligning tool while lowering the tubular string. The method may also comprise that the first tubular string portion is rotated in response to engaging the first tubular aligning tool with the first casing aligning tool. In an embodiment, the first tubular string may be rotated without damaging one or more control lines disposed along at least the first tubular string portion or the second tubular string portion. The method may additionally comprise that the first tubular string opening is rotationally aligned with a first casing string opening based on the rotating. The method may further comprise that the first tubular string portion is retained in an axial alignment and a rotational alignment with respect to the first casing opening. The method may comprise that the second tubular string portion is lowered relative to the first tubular string portion. The second tubular string portion may be lowered relative to the first tubular string portion by compressing a telescoping device to decrease the distance between the first tubular string opening and second tubular string opening. The method may also comprise that the second tubular aligning tool is engaged with a second casing aligning tool while the second tubular string portion is lowered relative to the first tubular string portion. The method may further comprise that the second tubular string portion is rotated in response to engaging the second tubular aligning tool with the second casing aligning tool while the first tubular string portion is retained in position. In an embodiment, the second tubular string may be rotated without damaging one or more control lines disposed along the second tubular string portion. The method may comprise that the second tubular string opening is rotationally aligned with a second casing string opening based on rotating the second tubular string portion. The second tubular string opening may be rotationally aligned with a second casing string opening based on rotating the second tubular string portion by compressing the telescoping device so that the distance between the first tubular string opening and the second tubular string opening is no greater than the distance between first casing string opening and the second casing string opening. The method may also comprise that the second tubular string portion is retained in an axial alignment and a rotational alignment with respect to the second casing string opening. The method may further comprise that the first tubular string portion indicates to be at a position before the first tubular aligning tool engages with the first casing aligning tool. The first tubular string portion can indicate to be at a position before the first tubular aligning tool engages with the first casing aligning tool by stopping the first tubular string from being lowered. An axial force lowering the first tubular string portion may be increased above a threshold to continue lowering the first tubular portion and to engage the first tubular aligning tool with the first casing string aligning tool. The method may further comprise that a first valve and/or a second valve is actuating after retaining the first tubular string portion and the second tubular string portion in an axial aligning and a rotational aligning with respect to the first casing string opening and the second casing string opening. The method may additionally comprise that fluid is communicated from a lateral bore after actuating at least a first valve or a second valve.

The method may comprise that the third tubular string portion is lowered relative to the first and second tubular string portions. The third tubular aligning tool can engage with a third casing aligning tool while the third tubular string portion is lowered relative to the first and second tubular string portions. The third tubular string portion may be rotated in response to engaging the third tubular aligning tool with the third casing aligning tool while the first and second tubular string portions are retained in position. The third tubular string opening may be rotationally aligned with a third casing string opening based on rotating the third tubular string portion. The third tubular string portion may be retained in an axial alignment and a rotational alignment with respect to the third casing string opening.

Having described the various systems and method herein, various embodiments may include, but are not limited to:

In a first embodiment, a method for orienting a tubing string in a wellbore comprises: lowering a tubular string within a casing string in a wellbore, engaging the tubular aligning tool with a casing aligning tool while lowering the tubular string, rotating the tubular string in response to engaging the tubing aligning tool with the casing aligning tool, rotationally aligning the tubular string opening with a casing string opening disposed through the casing string based on the rotating, and retaining the tubular string opening in an axial aligning and a rotational aligning with the casing string opening. The tubular string comprises: a tubular string opening and a tubular string aligning tool. In a second embodiment, lowering the tubular string in the first embodiment may comprise displacing the tubular string into a position where the tubular string opening is not at least partially aligned with the casing string opening. In a third embodiment, lowering the tubular string in the first or second embodiment may further comprise displacing the tubular string into an indication position where the tubular string aligning tool has not engaged with the casing string aligning tool. In a fourth embodiment, lowering the tubular string in the third embodiment may comprise displacing the tubular string out of the indication position by applying a force to release the tubular string. In a fifth embodiment, the method of any of the first to fourth embodiments may also include actuating a valve when the tubular string opening is at least partially aligned with the casing string opening and providing fluid communication between the casing string opening and the tubular string opening. In a sixth embodiment, rotating the tubular string in any of the first to fifth embodiments may comprise rotating the tubular string no more than 360 degrees.

In a seventh embodiment, a method for orienting a tubular string in a wellbore comprises: lowering a tubular string within a casing string in a wellbore, engaging the first tubular aligning tool with a first casing aligning tool while lowering the tubular string, rotating the first tubular string portion in response to engaging the first tubular aligning tool with the first casing aligning tool, rotationally aligning the first tubular string opening with a first casing string opening based on the rotating, retaining the first tubular string portion in an axial alignment and a rotational alignment with respect to the first casing opening, lowering the second tubular string portion relative to the first tubular string portion, engaging the second tubular aligning tool with a second casing aligning tool while lowering the second tubular string portion relative to the first tubular string portion, rotating the second tubular string portion in response to engaging the second tubular aligning tool with the second casing aligning tool while the first tubular string portion is retained in position, rotationally aligning the second tubular string opening with a second casing string opening based on rotating the second tubular string portion, and retaining the second tubular string portion in an axial alignment and a rotational alignment with respect to the second casing string opening. The tubular string comprises: a first tubular string portion and a second tubular string portion, and the first tubular string portion comprises a first tubular string opening and a first tubular aligning tool. The second tubular string portion comprises a second tubular string opening and a second tubular aligning tool, and the first tubular string portion is disposed below the second tubular string portion.

In an eighth embodiment, the tubular string of the seventh embodiment may also include a third tubular string portion, and the third tubular string portion comprises a third tubular string opening and a third tubular aligning tool. The method may also include lowering the third tubular string portion relative to the first tubular string portion and the second tubular string portion; engaging the third tubular aligning tool with a third casing aligning tool while lowering the third tubular string portion relative to the first and second tubular string portions; rotating the third tubular string portion in response to engaging the third tubular aligning tool with the third casing aligning tool while the first and second tubular string portions are retained in position; rotationally aligning the third tubular string opening with a third casing string opening based on rotating the third tubular string portion; and retaining the third tubular string portion in an axial alignment and a rotational alignment with respect to the third casing string opening. In a ninth embodiment, lowering the second tubular string portion relative to the first tubular string portion in the seventh or eighth embodiments may comprise compressing a telescoping device to decrease the distance between the first tubular string opening and second tubular string opening. In a tenth embodiment, rotationally aligning the second tubular string opening with a second casing string opening based on rotating the second tubular string portion in any of the seventh to ninth embodiments may comprise compressing the telescoping device so that the distance between the first tubular string opening and the second tubular string opening is no greater than the distance between first casing string opening and the second casing string opening. In an eleventh embodiment, the method of any of the seventh to tenth embodiments may also include indicating that the first tubular string portion is at a first indicator position before the first tubular aligning tool engages with the first casing aligning tool. In a twelfth embodiment, indicating that the first tubular string portion is at the first indicator position before the first tubular aligning tool engages with the first casing aligning tool in the eleventh embodiment may comprise stopping the first tubular string from being lowered. In a thirteenth embodiment, lowering the first tubular string portion in the twelfth embodiment may comprise increasing an axial force above a threshold to engage the first tubular aligning tool with the first casing string aligning tool. In a fourteenth embodiment, rotating at least one of the first tubular string or the second tubular string in any of the seventh to thirteenth embodiments may comprise rotating without damaging one or more control lines disposed along at least the first tubular string portion or the second tubular string portion. In a fifteenth embodiment, the method of any of the seventh to fourteenth embodiments may also include actuating at least a first valve or a second valve after retaining the first tubular string portion and the second tubular string portion in an axial alignment and the rotational alignment with respect to the first casing string opening and the second casing string opening. In a sixteenth embodiment, the method of the fifteenth embodiment may also include communicating fluid from a lateral bore after actuating at least a first valve or a second valve.

In a seventeenth embodiment, a system for orienting a tubular string with a wellbore comprises a casing string disposed in the wellbore, a first tubular string portion coupled to a second tubular string portion, and a first casing aligning tool and a second casing aligning tool coupled to the casing string. The casing string comprises: a casing string bore defined by the casing string, and a first casing string opening and a second casing string opening. The first casing string opening is further away from a wellbore surface than the second casing string opening. The first tubular string portion and the second tubular string portion are configured to be displaced into the casing string bore, The first tubing string portion comprises: a first tubular string opening configured to radially align with the first casing string opening, a first tubular aligning tool configured to engage with the first casing aligning tool upon being lowered into the wellbore and rotate the first tubular string portion to at least partially align the first tubular string opening with the first casing string opening, and a first holding device configured to prevent axial displacement of the first tubing string portion when the first tubing string opening is at least partially aligned with the first casing string opening. In an eighteenth embodiment, the first casing string opening of the seventeenth embodiment may be associated with a first lateral bore and the second casing string opening associated with a second lateral bore. In a nineteenth embodiment, the first aligning tool of the seventeenth or eighteenth embodiments may be associated with the first casing string opening and the second aligning tool is associated with the second casing string opening. In a twentieth embodiment, the system of any of the seventeenth to nineteenth embodiments may also include a first reference indicator configured to maintain the first tubing string portion in a position within the casing string bore before the first tubing string opening at least partially aligns with the first casing string opening, and a second reference indicator configured to maintain the second tubing string portion in a position within the casing string bore before the second tubing string opening at least partially aligns with the second casing string opening. In a twenty first embodiment, the first reference indicator of the twentieth embodiment may comprise a first set of latch couplings radially disposed along the casing string and a first set of latch keys disposed with the first tubular string portion. The first set of latch keys may be configured to be received by the first set of latch couplings, and the second reference indicator may comprise a second set of latch couplings radially disposed along the casing string and a second set of latch keys disposed with the second tubular string portion. The second set of latch keys may be configured to be received by the second set of latch couplings. In a twenty second embodiment, at least one of the first reference indicator or the second reference indicator of the twentieth or twenty first embodiments may be configured to notify an operator that the first tubing string opening is ready to at least partially align with the first casing string opening or that the second tubing string opening is ready to at least partially align with the second casing string opening, respectively. In a twenty third embodiment, the system of any of the seventeenth to twenty second embodiments may also include a first valve associated with the first tubular string opening and a second valve associated with the second tubular string opening. The first valve may be configured to control fluid communication from a first lateral bore, and the second valve may be configured to control fluid communication from a second lateral bore. In a twenty fourth embodiment, the system of any of the seventeenth to twenty third embodiments may also include a first set of one or more control lines disposed along the first tubular string portion and the second tubular string portion and a second set of one or more control lines disposed along the second tubular string portion. The first and second set of one or more control lines control one or more valves. In a twenty fifth embodiment, the first tubing string of any of the seventeenth to twenty fourth embodiments may rotate independently from the second tubing string. In a twenty sixth embodiment, the second tubing string portion of any of the seventeenth to twenty fifth embodiments may comprise a second tubular string opening configured to radially align with the second casing string opening, a second tubular aligning tool configured to engage with the second casing aligning tool upon being lowered into the wellbore and rotate the second tubular string portion to at least partially align the second tubular string opening with the second casing string opening, a second holding device configured to prevent rotational and axial displacement of the second tubing string portion when the second tubing string opening is at least partially aligned with the second casing string opening, and a telescoping device biased in an extended direction so that distance between the first tubing string opening and the second tubing string opening is greater than the distance between the first casing string opening and the second casing string opening. The telescoping device may be configured to change the distance between the first tubing string opening and the second tubing string opening such that when the telescoping device is contracted the distance between the first tubing string opening and the second tubing string opening is no greater than the distance between the first casing string opening and the second casing string opening.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, $R_l$, and an upper limit, $R_u$, is disclosed, any number falling within the range is specifically disclosed. In particular, the following numbers within the range are specifically disclosed: $R=R_l+k*(R_u-R_l)$, wherein k is a variable ranging from 1 percent to 100 percent with a 1 percent increment, i.e., k is 1 percent, 2 percent, 3 percent, 4 percent, 5 percent, . . . , 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present invention.

What is claimed is:

1. A method for orienting a tubing string in a wellbore, the method comprising:

lowering a tubular string within a casing string in a wellbore, wherein the tubular string comprises: a tubular string opening and, a tubular aligning tool;

engaging the tubular aligning tool with a casing aligning tool at an initial point along a declining seat of the casing aligning tool;

maintaining the tubular aligning tool engaged with the declining seat to a lowest point of the declining seat while lowering the tubular string;

rotating the tubular string by the engagement of the tubular aligning tool with the declining seat in response to engaging the tubular aligning tool with the casing aligning tool while lowering the tubular string;

rotationally aligning the tubular string opening with a casing string opening disposed through the casing string based on the rotating; and retaining the tubular string opening in an axial aligning and a rotational aligning with the casing string opening.

2. The method of claim 1, wherein lowering the tubular string comprises displacing the tubular string into a position where the tubular string opening is not at least partially aligned with the casing string opening.

3. The method of claim 1, wherein lowering the tubular string further comprises displacing the tubular string into an indication position where the tubular aligning tool has not engaged with the casing aligning tool.

4. The method of claim 1, further comprising actuating a valve when the tubular string opening is at least partially aligned with the casing string opening and providing fluid communication between the casing string opening and the tubular string opening.

5. The method of claim 1, wherein rotating the tubular string comprises rotating the tubular string no more than 180 degrees.

6. A method for orienting a tubular string in a wellbore, the method comprising:

lowering the tubular string within a casing string in a wellbore, wherein the tubular string comprises: a first tubular string portion and a second tubular string portion, wherein the first tubular string portion comprises a first tubular string opening and a first tubular aligning tool, wherein the second tubular string portion comprises a second tubular string opening and a second tubular aligning tool, and wherein the first tubular string portion is disposed below the second tubular string portion;

engaging the first tubular aligning tool with an inclined surface of a first casing aligning tool while lowering the tubular string;

rotating the first tubular string portion by the engagement of the first tubular aligning tool with the inclined surface of the first casing aligning tool in response to engaging the first tubular aligning tool with the first casing aligning tool while lowering the tubular string;

rotationally aligning the first tubular string opening with a first casing string opening based on the rotating;

retaining the first tubular string portion in an axial alignment and a rotational alignment with respect to the first casing opening;

lowering the second tubular string portion relative to the first tubular string portion;

engaging the second tubular aligning tool with an inclined surface of a second casing aligning tool while lowering the second tubular string portion relative to the first tubular string portion;

rotating the second tubular string portion by the engagement of the second tubular aligning tool with the inclined surface of the second casing aligning tool in response to engaging the second tubular aligning tool with the second casing aligning tool while lowering the second tubular string portion and while the first tubular string portion is retained in position;

rotationally aligning the second tubular string opening with a second casing string opening based on rotating the second tubular string portion; and retaining the second tubular string portion in an axial alignment and a rotational alignment with respect to the second casing string opening.

7. The method of claim 6, wherein the tubular string further comprises a third tubular string portion, wherein the third tubular string portion comprises a third tubular string opening and a third tubular aligning tool; and the method may further comprise:

lowering the third tubular string portion relative to the first tubular string portion and the second tubular string portion;

engaging the third tubular aligning tool with a third casing aligning tool while lowering the third tubular string portion relative to the first and second tubular string portions;

rotating the third tubular string portion in response to engaging the third tubular aligning tool with the third casing aligning tool while the first and second tubular string portions are retained in position;

rotationally aligning the third tubular string opening with a third casing string opening based on rotating the third tubular string portion; and retaining the third tubular string portion in an axial alignment and a rotational alignment with respect to the third casing string opening.

8. The method of claim 6, wherein lowering the second tubular string portion relative to the first tubular string portion comprises compressing a telescoping device to decrease the distance between the first tubular string opening and second tubular string opening.

9. The method of claim 8, wherein rotationally aligning the second tubular string opening with the second casing string opening based on rotating the second tubular string portion comprises compressing the telescoping device so that the distance between the first tubular string opening and the second tubular string opening is no greater than the distance between first casing string opening and the second casing string opening.

10. The method of claim 6, further comprising indicating that the first tubular string portion is at a first indicator position before the first tubular aligning tool engages with the first casing aligning tool.

11. The method of claim 10, wherein indicating that the first tubular string portion is at the first indicator position before the first tubular aligning tool engages with the first casing aligning tool comprises stopping the first tubular string from being lowered.

12. The method of claim 6, wherein rotating at least one of the first tubular string or the second tubular string comprises rotating without damaging one or more control lines disposed along at least the first tubular string portion or the second tubular string portion.

13. The method of claim 6, further comprising actuating at least a first valve or a second valve after retaining the first tubular string portion and the second tubular string portion in an axial alignment and the rotational alignment with respect to the first casing string opening and the second casing string opening.

14. A system for orienting a tubular string with a wellbore, the system comprising:

a casing string disposed in the wellbore, wherein the casing string comprises:

a casing string bore defined by the casing string, a first casing string opening and a second casing string opening, wherein the first casing string opening is further away from a wellbore surface than the second casing string opening, and a first casing aligning tool having a first inclined surface declining to a lowest point and a second casing aligning tool coupled to the casing string;

a first tubular string portion coupled to a second tubular string portion, wherein the first tubular string portion and the second tubular string portion are configured to be displaced into the casing string bore, wherein the first tubing string portion comprises:

a first tubular string opening configured to radially align with the first casing string opening, a first tubular aligning tool configured to engage with the first casing aligning tool and move along the first inclined surface toward the lowest point of the first inclined surface upon being lowered into the wellbore to thereby rotate the first tubular string portion to at least partially align the first tubular string opening with the first casing string opening, and a first holding device configured to prevent axial displacement of the first tubing string portion when the first tubing string opening is at least partially aligned with the first casing string opening.

15. The system of claim 14, wherein the first casing string opening is associated with a first lateral bore and the second casing string opening associated with a second lateral bore.

16. The system of claim 14, wherein the first casing aligning tool is associated with the first casing string opening and the second casing aligning tool is associated with the second casing string opening.

17. The system of claim 14, further comprising:

a first reference indicator configured to maintain the first tubing string portion in a position within the casing string bore before the first tubing string opening at least partially aligns with the first casing string opening, and a second reference indicator configured to maintain the second tubing string portion in a position within the casing string bore before the second tubing string opening at least partially aligns with the second casing string opening.

18. The system of claim 17, wherein the first reference indicator comprises a first set of latch couplings radially disposed along the casing string and a first set of latch keys disposed with the first tubular string portion, wherein the first set of latch keys are configured to be received by the first set of latch couplings and the second reference indicator comprises a second set of latch couplings radially disposed along the casing string and a second set of latch keys disposed with the second tubular string portion, wherein the second set of latch keys are configured to be received by the second set of latch couplings.

19. The system of claim 17, wherein at least one of the first reference indicator or the second reference indicator is configured to notify an operator that the first tubing string opening is ready to at least partially align with the first casing string opening or that the second tubing string opening is ready to at least partially align with the second casing string opening, respectively.

20. The system of claim 14, further comprising a first valve associated with the first tubular string opening and a second valve associated with the second tubular string opening, wherein the first valve is configured to control fluid communication from a first lateral bore and the second valve is configured to control fluid communication from a second lateral bore.

21. The system of claim 14, further comprising a first set of one or more control lines disposed along the first tubular string portion and the second tubular string portion and a second set of one or more control lines disposed along the second tubular string portion, wherein the first and second set of one or more control lines control one or more valves.

22. The system of claim 14, wherein the second tubing string portion comprises:

a second tubular string opening configured to radially align with the second casing string opening, a second tubular aligning tool configured to engage with the second casing aligning tool upon being lowered into the wellbore and rotate the second tubular string portion to at least partially align the second tubular string opening with the second casing string opening, a second holding device configured to prevent rotational and axial displacement of the second tubing string portion when the second tubing string opening is at least partially aligned with the second casing string opening, and a telescoping device biased in an extended direction so that distance between the first tubing string opening and the second tubing string opening is greater than the distance between the first casing string opening and the second casing string opening, wherein the telescoping device is configured to change the distance between the first tubing string opening and the second tubing string opening such that when the telescoping device is contracted the distance between the first tubing string opening and the second tubing string opening is no greater than the distance between the first casing string opening and the second casing string opening.

* * * * *